United States Patent [19]

Perry

[11] 3,938,429

[45] Feb. 17, 1976

[54] ROOF AIR VENT

[75] Inventor: Raymond S. B. Perry, Miami, Fla.

[73] Assignee: Plastic Components, Inc., Miami Springs, Fla.

[22] Filed: Sept. 19, 1971

[21] Appl. No.: 507,616

[52] U.S. Cl. ..... 98/37; 98/114; 52/542

[51] Int. Cl.[2] ..... F24F 13/18

[58] Field of Search..... 98/37, 114, 40 D, 121 R, 98/40 C, 42, DIG. 6; 52/475, 507, 510, 542

[56] References Cited

UNITED STATES PATENTS

| | | | |
|---|---|---|---|
| 1,540,788 | 6/1925 | McClure | 98/114 X |
| 1,706,924 | 3/1929 | Kane | 52/542 X |
| 2,221,001 | 11/1940 | Lucius | 98/40 D |
| 3,303,771 | 2/1967 | Nesher et al. | 98/40 D |

*Primary Examiner*—William E. Wayner
*Attorney, Agent, or Firm*—Clarence A. O'Brien; Harvey B. Jacobson

[57] ABSTRACT

A roof air vent having rails mountable about an opening in a roof for forming a support bracket for one or more perforated panels. A pair of the rails are parallel to one another for forming tracks in which the panels are inserted.

4 Claims, 6 Drawing Figures

Fig. 1
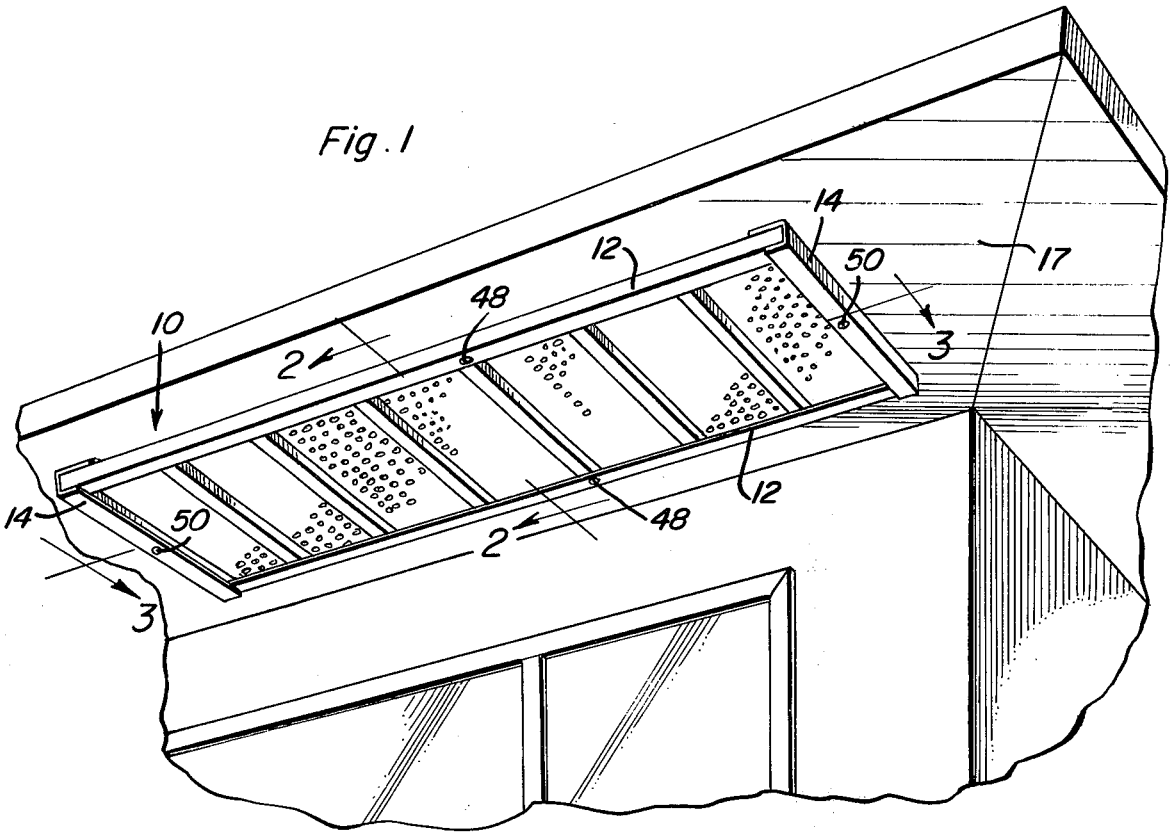
Fig. 2
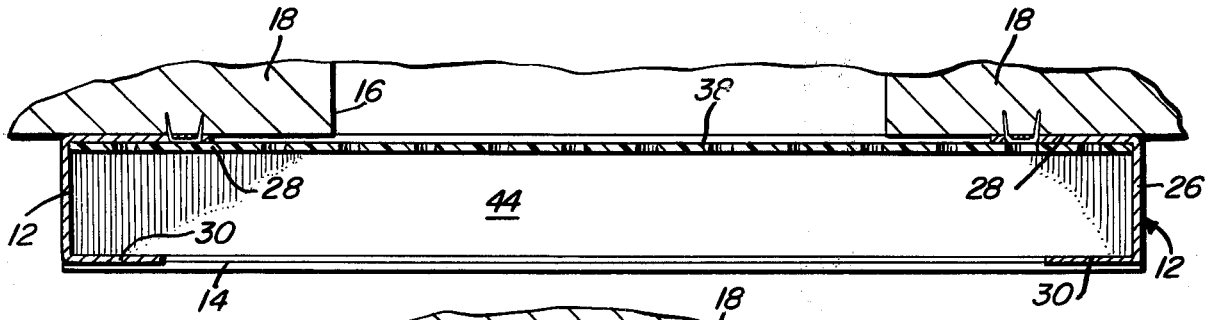
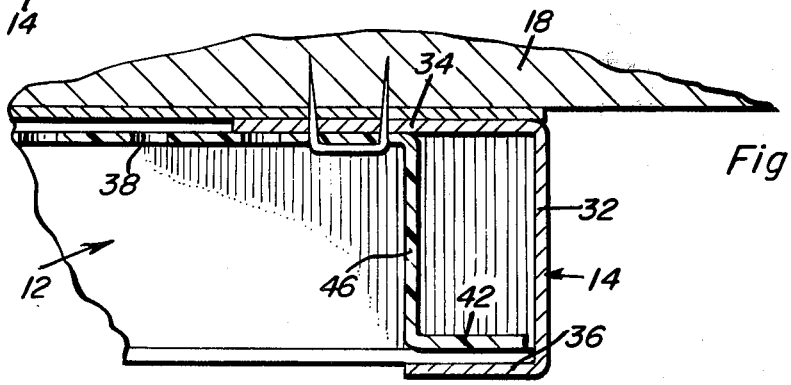
Fig. 4

Fig. 3
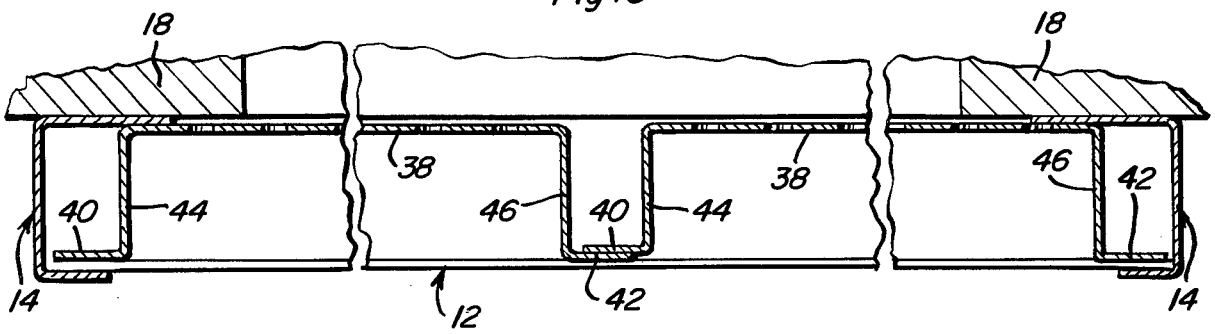
Fig. 5
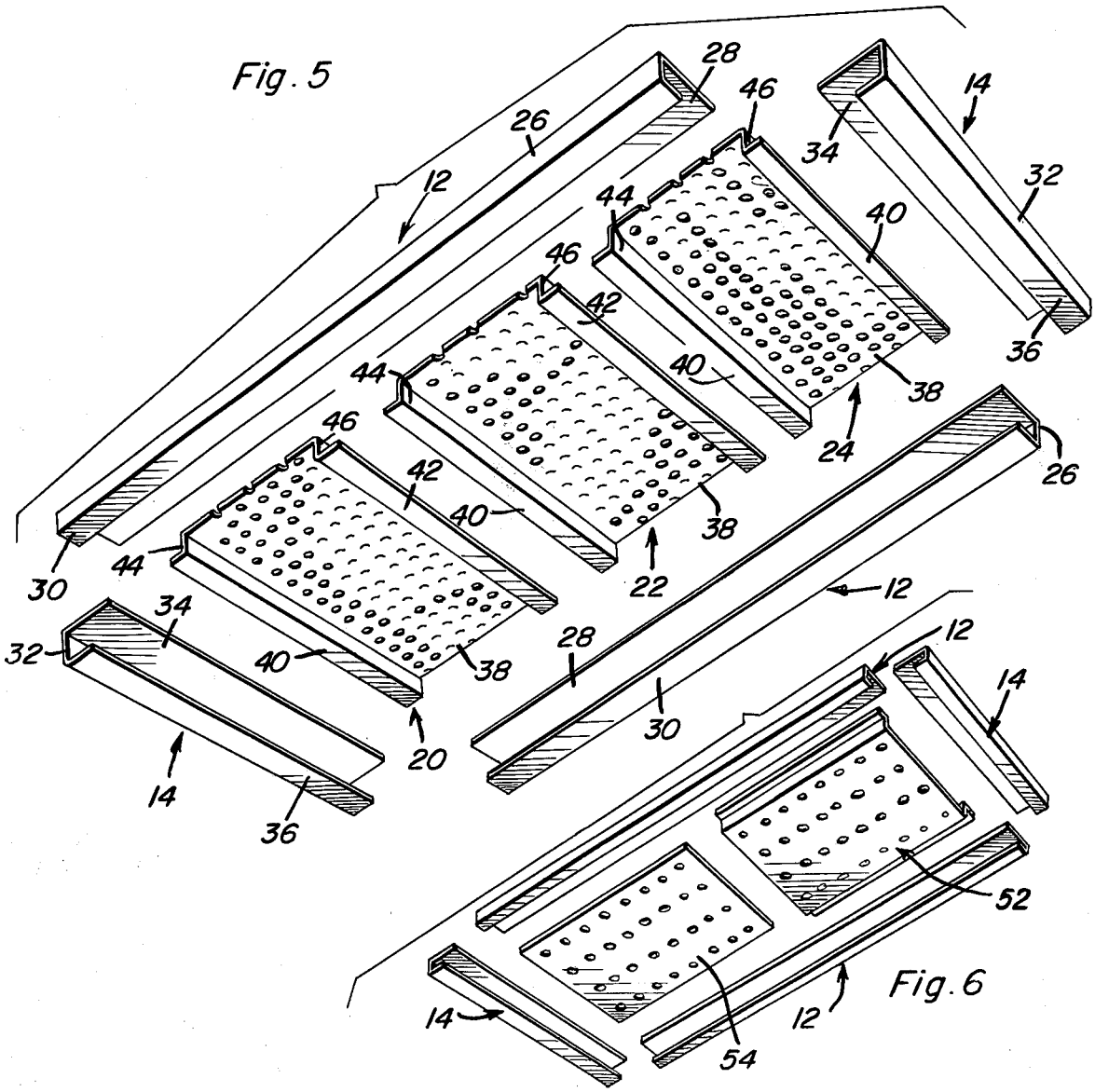
Fig. 6

ROOF AIR VENT

BACKGROUND OF THE INVENTION

1. Field of the Invention

This invention relates generally to air vents, and particularly to an air vent usable for covering the vent openings in roof overhangs, and the like, in new and existing structures.

2. Description of the Prior Art

In buildings provided with overhanging roof constructions it is conventional to provide air vent openings in the under portions of the roof overhangs. These openings are generally covered by air vents that are susceptible to becoming rotted, torn, rusted, and the like, thus requiring occasional replacement.

Prior patents considered pertinent to this invention are as follows:

| | |
|---|---|
| 2,780,978 | Feb. 12, 1957 |
| 2,803,185 | Aug. 20, 1957 |
| 2,969,726 | Jan. 31, 1961 |
| 3,051,071 | Aug. 28, 1962 |
| 3,125,942 | Mar. 24, 1964 |
| 3,256,654 | June 21, 1966 |

SUMMARY OF THE INVENTION

It is an object of the present invention to provide a long lasting air vent constructed in sections that can be assembled over air vent openings in roof overhangs or other parts of a roof by an unskilled worker, such as the average homeowner, with a minimum of tools and effort when one wishes to replace rotted, torn, rusted, and other defective, existing air vents.

It is another object of the present invention to provide an air vent easily installable over roof air vent openings in new construction.

It is still another object of the present invention to provide an air vent which is long lasting and requires a minimum of maintenance.

These and other objects are achieved according to the present invention by providing an air vent having: rails mountable about an opening in a roof, and the like, for forming a support bracket; and a perforated panel arrangeable in the rails for covering the opening. If necessary, a plurality of perforated panels may be arranged in the rails for covering the opening.

The rails advantageously include a pair of parallel, side rail forming tracks, each of which has a web and a pair of spaced, parallel legs extending codirectionally from the web. One of the legs is advantageously longer than the other of the legs for providing a surface easily attachable to building structures such as soffit boards, and the like.

The perforated panel advantageously includes a perforated planar median portion bracketed by a pair of parallel flanges connected to the median portion in offset relationship thereto by transition portions. When a plurality of perforated panels is employed, adjacent flanges of the panels overlap one another.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing the arrangement of an air vent according to the present invention over a ventilator provided in the soffit of an overhanging roof.

FIG. 2 is a fragmentary, sectional view taken generally along the line 2—2 of FIG. 1.

FIG. 3 is a fragmentary, sectional view taken generally along the line 3—3 of FIG. 1.

FIG. 4 is a fragmentary, sectional view, showing a portion of FIG. 3 drawn to a larger scale.

FIG. 5 is an exploded perspective view showing an air vent according to the present invention.

FIG. 6 is an exploded perspective view similar to FIG. 5, but showing a modified embodiment of the invention.

DESCRIPTION OF THE PREFERRED EMBODIMENTS

Referring now more particularly to the drawings, a roof air vent 10 according to the present invention has two pairs of rails 12 and 14 mountable about an opening 16 forming a ventilator in the underside 17 of an overhanging roof. The opening 16 is advantageously provided in soffit boards 18 as illustrated. A plurality of perforated panels 20, 22, and 24 (FIG. 5) are arrangeable in rails 12, 14 for covering opening 16.

Rails 12 include a pair of side rail forming, parallel racks, each having a web 26 and a pair of spaced, parallel legs 28 and 30 extending codirectionally from web 26. As can be appreciated from FIG. 2 of the drawings, leg 28 is longer than leg 30 for providing a surface permitting easy attachment of leg 28 to appropriate building structure. Rails 14 include a pair of end rails similar in construction to the side rail forming tracks and arrangeable across the ends of the tracks. As can be appreciated from FIGS. 3 and 4 of the drawings, rails 14 each have a web 32 from which extend codirectional and parallel legs 34 and 36. Further, like rails 12, the legs 34, 36 of rails 14 are of unequal length so that leg 34 will provide sufficient surface for tacking of the rails to suitable supporting structure.

Each panel 20, 22, and 24, it being understood that more than three or less than three such panels may be employed with rails, 121, 14, has a perforated planar median portion 38 bracketed by a pair of oppositely directed parallel, substantially planar flanges 40 and 42 connected to portion 38 in a known manner and in offset relationship therewith by transition portions 44 and 46. As can be appreciated, the panels may be formed as a single piece. As can best be seen from FIG. 3 of the drawings, the flanges 40, 42 are arranged in overlapping relationship one to the other when a plurality of panels are arranged in the tracks formed by rails 12.

When using a vent 10 according to the present invention with new building construction, an opening 16 is formed by pre-cutting a hole in soffit boards 18 which form the underside of the roof overhang. Rails 12 may now be nailed or stapled in a conventional manner along both of a pair of parallel sides of opening 16 to form a track for a panel or panels to slide into. Once the panels are in position, rails 14 may be nailed or stapled across the ends of rails 12. The rails may come in, for example, four foot lengths, with standard packaging of fifty rails per box.

The applicator, or person installing vent 10, may use a ladder (not shown) and the like to first apply two four foot lengths of rail 12 adjacent the sides of opening 16. Having received rails 12 in four foot lengths, he can either cut these tracks with scissors, and the like, to fit whatever size hole exists, or the applicator can butt the tracks end to end to form a continuous vent for longer lengths. Rails 14 are applied to one end by slipping the longer leg 34 under the track ends and the shorter leg 36 over the top of the track ends as shown in FIGS. 3 and 4. Staples, and the like, in each corner tack the rails to the soffit board. Standard lengths of panels 20, 22, 24 are then cut to predetermined length with scissors, and the like, and thread into the tracks formed by rail 12. These panels are fitted snugly next to each other by overlapping the lips or flanges 40, 42. The perforated median portion 38 of the panels is placed on the top side so that the last panel is over and against the longer legs of the rails 12 and 14, making it convenient to pin all three parts to the soffit board with one staple at both corners.

Rails 12, 14 and the various panels employed therewith may be constructed from, for example, rigid polyvinyl chloride such as that produced by B. F. Goodrich Chemical Company under their designation No. 8700A. This material has proven weathering characteristics and has an impact strength strong enough to withstand blows from a hammer, stapling gun, and the like. Further, this material comes in a permanent white color which may be painted to whatever color desired.

The perforations in median portion 38 may be, for example, ⅛ inch in diameter which conforms to FHA building code. There may be, for example, a line of eight holes followed by a line of nine holes alternating across the width.

When used in new building construction, holes 48 and 50 are provided in rails 12, 14. For such applications, the vent may be constructed in one piece in various sizes in the factory, and the aforementioned holes drilled prior to shipment. These nail holes 48, 50 provide a means for adhering the vent over openings in wood soffits and the like. In addition, the nail holes allow the vent to be used in stucco roof soffits by nailing the vent over wire lath into the joists associated therewith. When fabricated in a factory, the panels and rails may be fastened to one another in a suitable manner, such as by welding, to form an integral unit.

Thus, a vent 10 may be constructed in two forms. First, a factory made vent may be provided for being nailed in place by building contractors, and, second, a knock-down vent may be supplied in pieces for a homeowner, and the like, to use when repairing his roof air vents. The prefabricated vents may, of course, be used also by homeowners, and the like.

FIG. 6 shows an alternative embodiment of the invention, wherein a panel 52 is, for example, wider than panel 24, and is turned lengthwise with respect to the rails so there will be, for example, only one panel, say, per foot of linear rail length. Further, the panels 52 might be made in various widths, and might be a flat panel 54 without flanges.

As can be appreciated from the above description and from the drawings, a roof air vent according to the present invention provides an easier way to repair an air vent existing in a roof. Further, since the vent according to the present invention is to be installed on the outer surface of the structure forming the ventilator, it is not necessary to remove any damaged vent originally installed on the inside surface of the ventilator. A vent according to the present invention eliminates need to remove, repair, and reinstall air vents originally placed on the outside of soffit boards, and the like, since the old vent may be merely removed and discarded when the new vent is put up. A vent according to the present invention provides a longer lasting vent than screen wire, and the like. The aesthetic properties of a vent according to the present invention will improve the appearance of a roof with which the vent is employed. A vent according to the present invention provides a single means for repairing any size, configuration, or type of vent, and may be provided in convenient kit form to facilitate carrying, storing, and use. A vent according to the present invention is the only repair means for vents available that allows an applicator to staple rather than nail or glue. Finally, the overlap of the lips or flanges provides a security against bug infiltration through the vent.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A roof air vent, comprising, in combination:

a. rails mountable about an opening in a roof for forming a support bracket; and b. a perforated panel arrangeable in the rails for covering the opening, the rails including a pair of side rail forming, parallel tracks, each of the tracks having a web and a pair of spaced, parallel legs extending codirectionally from the web, with one of the legs being longer than the other of the legs for providing a surface attachable to a building structure, the rails further including a pair of end rails similar in construction to the side rail forming tracks and arrangeable across the ends thereof, the panel consisting of a perforated planar median portion bracketed by a pair of oppositely directed substantially planar parallel flanges connected to the median portion in offset relationship thereto by transition portions.

2. A structure as defined in claim 1, wherein there is a plurality of perforated panels arranged in the guide rails, with adjacent flanges of the panels overlapping one another, the flanges being arranged transverse of the rails, and abutting the other of the legs of the rails.

3. A structure as defined in claim 1, in combination with a roof overhang having a ventilator opening provided in the soffit thereof, the rails being arranged about the opening.

4. A structure as defined in claim 1, wherein there is a plurality of perforated panels arranged in the guide rails, with the flanges of the panels engaging the other of the legs.

* * * * *